United States Patent [19]

Grobin, Jr.

[11] 4,054,453

[45] Oct. 18, 1977

[54] LIPPMANN FILM WITH REFLECTIVE LAYER

[75] Inventor: Allen W. Grobin, Jr., Poughkeepsie, N.Y.

[73] Assignee: International Business Machines Corporation, Armonk, N.Y.

[21] Appl. No.: 72,514

[22] Filed: Sept. 15, 1970

Related U.S. Application Data

[63] Continuation of Ser. No. 563,437, July 7, 1976, abandoned.

[51] Int. Cl.[2] ..... G03C 1/76; G03C 7/00; G03C 5/04; G03C 1/90

[52] U.S. Cl. ..... 96/67; 96/2; 96/27 E; 96/83

[58] Field of Search ..... 96/67, 2, 71, 40, 80, 96/81, 83, 27 E; 350/3.5, 163, 164; 355/2

[56] References Cited

U.S. PATENT DOCUMENTS

| | | | |
|---|---|---|---|
| 2,522,812 | 9/1950 | Bonnet | 96/67 |
| 2,595,670 | 5/1952 | Goehner | 96/67 |
| 3,107,170 | 10/1963 | Netke | 96/2 |

OTHER PUBLICATIONS

British Journal of Photography, Jan. 3, 1919 Supplement pp. 3–4.

*Primary Examiner*—Mary F. Kelley
*Attorney, Agent, or Firm*—Robert Lieber

[57] ABSTRACT

A film for use in Lippmann photography is formed with a photosensitive emulsion on a transparent base and a separable reflective layer adhering to the emulsion. This separable layer may be a reflective coating carried by a soluble coating, or both soluble and insoluble coatings, or may be a reflective coating of a normally liquid metal which adheres to the emulsion and is readily separated by solvent or reactant.

5 Claims, 3 Drawing Figures

LIPPMANN FILM WITH REFLECTIVE LAYER

CROSS-REFERENCE TO RELATED APPLICATION

This is a continuation of U.S. Ser. No. 563,437 filed July 7, 1976, now abandoned.

This invention relates to a film suitable for use in the photographic process known as Lippmann photography.

In this process, earlier developed by Gabriel Lippmann, a reflective surface is held in close contact with the photosensitive emulsion of a photographic film and the emulsion is exposed by passing light through the transparent carrier base and reflecting the light back by the reflective surface. Originally, mercury was used and was removed after the emulsion had been exposed.

Interference between the directed and reflected light rays forms standing waves in the emulsion, the antinodes representing the points of peak energy and of maximum exposure in the emulsion. These antinodes in a silver halide emulsion form strata or surfaces at each point which are spaced by one-half wavelength of light in the emulsion. When the mercury is removed from contact with the emulsion, and the emulsion developed, strata of metallic silver are formed and the film will reflect light of the wavelengths used in recording.

This process has not proved practical because handling of the liquid mercury for the reflecting surface is inconvenient and the mercury desensitizes the emulsion. Other attempts at providing a reflecting surface fixed to the film, as by forming the emulsion on a metallic layer, have been unsuccessful. Applicant has discovered a reflective layer and method of applying and removing the layer which overcomes the disadvantages of earlier attempts.

This removable reflective layer may be formed as a soluble translucent coating on the emulsion surface with a metallic reflecting coating deposited on the translucent coating to form a mirror surface so that the layer may be removed by peeling from the emulsion or by softening or dissolving the translucent coating. This translucent coating preferably is transparent. The reflective layer also be a metallic coating deposited directly on the emulsion if the layer does not affect the photosensitive emulsion.

The important object of this invention is to provide a photosensitive emulsion, such as a Lippmann type emulsion, with a removable reflective layer having a mirror surface in contact with the emulsion surface, so that the mirror surface is close enough to the emulsion surface to reflect light waves and form standing waves. This reflective layer may be removed after exposure and the emulsion developed and fixed in the usual manner. It may then be exhibited in white light to reflect different colors corresponding to single wavelengths at the recording points.

It is another object of this invention to form a reflective layer on emulsion for use in the Lippmann process by providing a reflective layer having a thin, translucent soluble coating or pellicle on said emulsion carrying a metallic reflective coating. The layer may be washed or peeled off or may be removed with a solvent for the translucent coating.

In either specific application, the metallic coating reflects the light back through the emulsion to form the standing waves and produce the reflecting strata of silver in the emulsion as in the Lippmann process. This reflecting layer may then be removed and the film developed and fixed for exhibition as the known Lippmann photograph.

Figure 1:
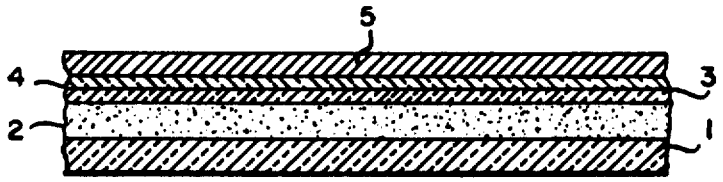
FIG. 1 shows an emulsion made up of a plurality of layers according to this invention.

One preferred form of the invention is illustrated in FIG. 1, in which the transparent carrier base 1 carries the photosensitive emulsion 2. The reflective layer on the surface of said emulsion 2 is formed of a water-soluble coating 3 and a water-insoluble coating 4 on coating 3. A coating of silver 5 is chemically desposited on the coating 4 to form a mirror surface for reflecting light passing through the carrier base 1 and emulsion 2 and coatings 3 and 4. The thickness of the coatings 3 and 4 must not exceed the coherence length of the light reflected. As an example, coatings may be on the order of 20 microns, and not exceeding 25 microns, for use with substantially incoherent light as derived from narrow band interference filters. Coatings as thin as 1 micron have been used successfully.

The light image to be recorded is projected onto the carrier base face, passing through the emulsion 2 and coatings 3 and 4 to strike the reflective surface of the silver coating 5. The direct and reflected waves form standing waves in the emulsion, as in the known Lippmann process, forming latent images in the photosensitive emulsion in surfaces or strata corresponding to half wavelengths of light at each point. After exposure, the reflecting layer is removed, as for example, by dissolving or softening the water-soluble coating and peeling off the non-soluble and metallic coatings. The emulsion is then developed and fixed, with the consequent reduction of silver halide to silver in the strata to reflect light of corresponding half wavelengths, as in the known Lippmann photography.

Figure 2:
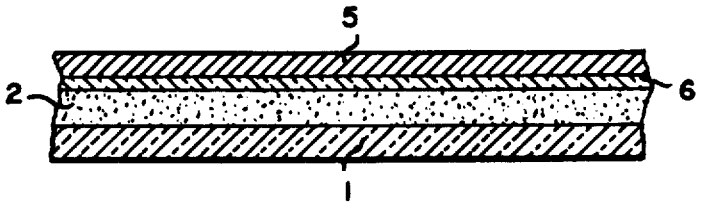
FIG. 2 shows another form.

In the form shown in FIG. 2, the reflective layer on the emulsion 2 is formed by a single, translucent water-soluble coating 6 and the metallic coating 5. The metallic coating of silver may be peeled off or removed by softening or dissolving the water-soluble coating, or it may be washed off by a flow wash which dissolves coating 6. The reflective layer on the emulsion 2 may also be formed of a single translucent water-insoluble coating with a metallic coating deposited on it. To remove the metallic coating, the water-insoluble coating may be softened or dissolved with organic solvents. It may also be washed off by a solvent flow wash.

The soluble coatings may be those which will not affect the photosensitive emulsion. Certain water-soluble coatings which are soluble in cold water are the polyvinyl alcohols, and their substituted alcohols and their homologs. Hot water-soluble coatings may be used for the coating which can be peeled off. Hot water-soluble coatings may be used at a temperture not exceeding 120° F. to avoid affecting the emulsion.

A hot water-soluble plastic coating is formed by the following mixture:

| | |
|---|---|
| Dupont Elvanol 73-125 (Polyvinyl alcohol) | 40 g/l |
| Isopropyl alcohol | 150 ml/l |
| Glycerin | 8 g/l |
| Distilled water | to volume of 1 l. |
| Viscosity | 60 centipoises |

A water-insoluble coating compatible with the above coating is given below:

| | |
|---|---|
| Dow Saran F-120 (Copolymer of vinylidene chloride and acrylonitrile) (1,000 centipoise grade) | 32.5 g/l |
| Cyclohexanone | 500 ml/l |
| Isopropyl alcohol | 12 ml/l |
| Methyl ethyl ketone | 250 ml/l |
| Toluene | 250 ml/l |

The water-soluble coating may be cold water-soluble by substituting Elvanol 51-05 or 52-22, 85% hydrolized for the Elvanol 73-125 in the hot water-soluble mixture. Instead of the insoluble coating, the coating may be partially soluble by substituting Elvanol 72-60, 44 g/l, fully hydrolized in the hot water-soluble mixture. This partially soluble coating is especially advantageous for use with certain separation techniques. When partially softened, the coating will slide off from the soluble coating, carrying the metal reflecting layer intact. This procedure avoids metal particles in the bath and contamination of the emulsion. In any of these coatings, the isopropyl alcohol and glycerin in these mixtures form an optical meeting face between the coatings or with the emulsion that eliminates interference fringes, as well as acting as plasticisers.

The water-soluble coatings may also include other miscible inorganic solvents. Examples of suitable resins for these coatings are vinyl acetate or chloride, and copolymers of these materials. Vinylidene chloride acrylonitrile (Saran F-120) has been used successfully. These coatings are peelable or are soluble in organic solvents such as cyclohexanone.

The silver mirror is chemically deposited by any suitable process, such as the Brashear process, since vapor deposition or similar methods may adversely react on the photosensitive emulsion. An example is given in U.S. Pat. No. 1,935,520 to Peacock. In using this process, applicant sprays on the silver coating in two sprays, one composed of 25 g/l of silver nitrate and 20 ml/l of 28% ammonium hydroxide and the other of 12 g/l of hydrazine sulfate and 3 g/l of magnesium sulfate. These two sprays are applied simultaneously to form the silver coating. The plastic coating on the emulsion will protect the photosensitive material such as silver halide from reaction with the silvering compounds.

Various other metal reflective surfaces may be used instead of silver. Certain metals and alloys which are normally liquid will "wet" the surface and adhere by contact, and these may form highly reflective surfaces. Gallium and indium, for example, have low contact angles and "wet" materials on contact. These elements also impart this property to their liquid alloys, some of which are described herein. Such metal surfaces may be applied to the translucent coatings 4 or 6 of FIGS. 1 or 2 in place of the silver coating 5, or may form a reflective layer by coating the emulsion 2 directly.

Figure 3:
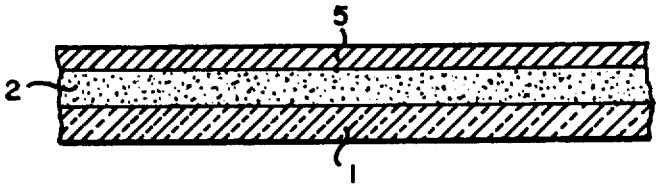
FIG. 3 shows a third arrangement of layers.

This last arrangement is illustrated in FIG. 3, in which the reflective layer 7 may be composed of any of several suitable metals or alloys. Gallium is liquid at room temperature and when rubbed on the emulsion 2, forms a reflective layer on the emulsion. To avoid defects in the image reflected, the gallium must be of the highest purity, preferably 99.9999+% pure and at least 99.99+%. This purity avoids the occurrence of minor imperfections which will cause defects in the light reflections.

Certain alloys will also be liquid and can be applied to the emulsion in the same manner. An alloy of 25% indium and 75% gallium has been used. Gallium and mercury in widely varying proportions will form a liquid alloy and may be applied in the same manner. Indium and mercury will also form a liquid alloy, with varying proportions of 46 to 90% indium and 54 to 10% mercury.

The metal coating may be washed off the emulsion by a water wash with dilute sodium hydroxide or sodium carbonate solution. These solutions will react readily with the gallium and indium. While mercury may densensitize the silver halide in the emulsion, mercury in an alloy has less effect on the emulsion, so that an alloy of 20% mercury with indium has no desensitizing effect, and above this amount the effect is much reduced. Any of these coatings may be removed by the wash, as described above. Preferably, the wash is in the form of a spray, so as to carry off the metal particles without contaminating the emulsion.

While there have been shown and described herein certain preferred embodiments of the invention, it will be understood that the invention is not intended to be limited thereto or to details thereof and departures may be made therefrom within the spirit and scope of the invention as defined in the following claim.

I claim:

1. An element for use in the Lippmann process comprising a transparent base, a layer of an unexposed photosensitive silver halide emulsion over and in contact with said base, and a separable reflective composite layer over and in contact with said emulsion; said composite layer including a first translucent coating sublayer in contact with said emulsion susceptible of being dissolved in a solvent which does not affect the photosensitivity of said emulsion, a second translucent coating sublayer over and in contact with said soluble coating sublayer which is insoluble in said solvent, and a light reflecting coating sublayer over and in contact with said insoluble coating sublayer.

2. An element according to claim 1, in which said solvent is from the group consisting of (1) water, (2) an organic solvent.

3. An element according to claim 1, in which said light reflecting coating is of light reflecting metal.

4. An element for use in the Lippmann process comprising a layer of an unexposed, photosensitive silver halide emulsion and a separable, reflective composite in contact with said emulsion; said composite including first, second and third layers; said first layer consisting of a water soluble translucent coating in contact with said emulsion, said second layer consisting of a water insoluble translucent coating in contact with said soluble coating, and said third layer consisting of a light reflecting coating of metallic silver in contact with said water insoluble coating, the combined thickness of said soluble and insoluble translucent layers not exceeding the coherence length of light to be used for exposing said emulsion.

5. An element for use in the Lippmann process comprising a transparent base, a layer of an unexposed, photosensitive silver halide emulsion over and in contact with said base, and a separable, reflective composite over and in contact with said emulsion; said separable composite including a translucent layer over and in contact with said emulsion said translucent layer being separable from said emulsion by being soluble in a solvent which does not affect the photosensitivity of said emulsion, and a reflective layer over and in contact with said translucent layer, said reflective layer consisting of a coating on said translucent layer of a metal selected from the group consisting of (1) alloys of indium and gallium, (2) alloys of gallium and mercury, (3) alloys of indium and mercury, said indium and gallium in said alloys of indium and gallium being in the proportion of 25% and 75%, respectively, and said indium and mercury alloy containing not more than 20% mercury; the thickness of said translucent layer not exceeding the coherence length of light useful to expose said emulsion for Lippmann-image formation.

* * * * *